US005273411A

United States Patent [19]

Lipscombe

[11] Patent Number: 5,273,411

[45] Date of Patent: Dec. 28, 1993

[54] ROTARY POSITIVE DISPLACEMENT HYDRAULIC MACHINES

[75] Inventor: Brian R. Lipscombe, Cheltenham, England

[73] Assignee: Ultra Hydraulics Limited, Gloucester, England

[21] Appl. No.: 866,097

[22] Filed: Apr. 6, 1992

[51] Int. Cl.[5] ..... F01C 19/08; F01C 19/10

[52] U.S. Cl. ..... 418/132; 418/131

[58] Field of Search ..... 418/131, 132, 135

[56] References Cited

U.S. PATENT DOCUMENTS

| | | | |
|---|---|---|---|
| 2,622,534 | 12/1952 | Johnson | 418/132 |
| 3,068,804 | 12/1962 | Thrap et al. | 418/132 |
| 3,671,154 | 10/1970 | Kolbe et al. | 418/131 |

FOREIGN PATENT DOCUMENTS

| | | |
|---|---|---|
| 0157049 | 10/1985 | European Pat. Off. . |
| 556390 | 10/1943 | United Kingdom . |
| 0886072 | 1/1962 | United Kingdom . |
| 1287440 | 8/1972 | United Kingdom . |
| 1410988 | 10/1975 | United Kingdom . |
| 2054742 | 2/1981 | United Kingdom . |

*Primary Examiner*—Richard A. Bertsch
*Assistant Examiner*—Charles Freay
*Attorney, Agent, or Firm*—Young & Thompson

[57] ABSTRACT

A rotary positive displacement hydraulic machine such as a gear pump or motor, comprises a housing defining two mutually intersecting parallel working chambers, two meshing rotors mounted for rotation in the two chambers, respectively, and two bearing supports at opposite ends of the parallel chambers and each supporting bearings in which the two rotors are journalled for rotation. The housing is open at one or both ends. The or each open end of the housing has a hollow, non-circular spigot which is received in a recess of matching non-circular shape defined by a continuous flange projecting from a peripheral region of a respective bearing support in a direction parallel to the axes of rotation of the meshing rotors and which is surrounded by a shoulder extending from the spigot to the peripheral edge of the housing, so that the or each open end of the housing is supported by its bearing support against outwards movement in a plane transverse to the axes of rotation of the meshing rotors.

6 Claims, 4 Drawing Sheets

ROTARY POSITIVE DISPLACEMENT HYDRAULIC MACHINES

INTRODUCTION

This invention relates to rotary positive displacement hydraulic machines, such as gear pumps and motors.

Rotary positive displacement hydraulic machines, in the form of gear pumps and motors, generally comprise a housing having two mutually intersecting parallel working chambers, two meshing rotors mounted for rotation in respective chambers, two bearing supports at opposite ends of the parallel chambers, and two end covers closing opposite ends of the housing. Often the bearing supports are integral with respective end covers. Also, one of the end covers (and sometimes one bearing support) is in some cases formed integrally with the housing. These are commonly referred to as "pot-bodied" machines and are cheaper to make. The end cover or covers which are not integral with the housing (and which may be separate from or integral with a respective bearing support) are secured to the housing by bolts which extend through the housing and end cover(s). In some cases, dowels are provided between the housing and the or each non-integral end cover and, in some other cases, a part of the or each non-integral end cover (or its respective bearing support) fits inside the housing in order to position the or each non-integral end cover, or its respective bearing support, relative to the housing.

When, for example, these known machines are used as pumps, hydraulic fluid is drawn into the chambers through a low pressure inlet port and is delivered to a high pressure outlet port by rotating pockets between the rotors and the housing. The operating pressure on the delivery side of the pump is very high, often as high as 250 bar, and it follows that the pressure differential between the inlet or suction side of the pump and the outlet or delivery side of the pump is also very high.

In order to ensure good volumetric efficiency, it is important that liquid clearance losses between low and high pressure sides of the pump are kept to a minimum. It is also important to maintain proper alignment of the bearings as otherwise the performance and durability of the bearings will decrease. The high pressure on the outlet or delivery side of the pump causes the housing to deflect and can also cause one or both bearing supports to move relative to the housing. This increases the radial clearance losses thus reducing the volumetric efficiency of the machine and can also cause the bearings to move out of alignment, particularly in "pot-bodied" machines where the deflection occurs at one end only.

The present invention seeks to provide a rotary positive displacement hydraulic machine in which the deflection of the housing and movement of the bearing support(s) relative to the housing resulting from fluid pressure therein are reduced.

SUMMARY OF THE INVENTION

According to the present invention there is provided a rotary positive displacement hydraulic machine in the form of a gear pump or motor comprising a housing defining two mutually intersecting parallel working chambers, two meshing rotors mounted for rotation in the two chambers, respectively, and two bearing supports at opposite ends of the parallel chambers and each supporting bearings in which the two rotors are journalled for rotation, wherein the housing is open at one or both ends and wherein the or each open end of the housing has a hollow, non-circular spigot which is received within a recess of matching non-circular shape defined by a continuous flange projecting from a peripheral region of a respective bearing support in a direction parallel to the axes of rotation of the meshing rotors and which is surrounded by a shoulder extending from the spigot to the peripheral edge of the housing, so that the or each open end of the housing is supported by its bearing support against outwards movement in a plane transverse to the axes of rotation of the meshing rotors.

Preferably, one end of the housing is closed by an integral end cover and in this case the bearing support at the said one end of the housing is preferably integral with the said integral end cover. This is typical of a "pot-bodied" machine.

Preferably, the or each open end of the housing is closed by a removable end cover and in this case the bearing support at the or each open end of the housing is preferably integral with its respective end cover.

Advantageously, a pressure balancing plate is interposed between the meshing rotors and an adjacent bearing support and an area of that face of the pressure balancing plate which is remote from the meshing rotors communicates with the working space of the machine so that, in use, the pressure balancing plate is urged into adequate sealing engagement with the meshing rotors without the generation of undue friction between the pressure balancing plate and the rotors.

The invention will now be more particularly described, by way of example, with reference to the accompanying drawings.

DESCRIPTION OF THE PREFERRED EMBODIMENT

Figure 1:
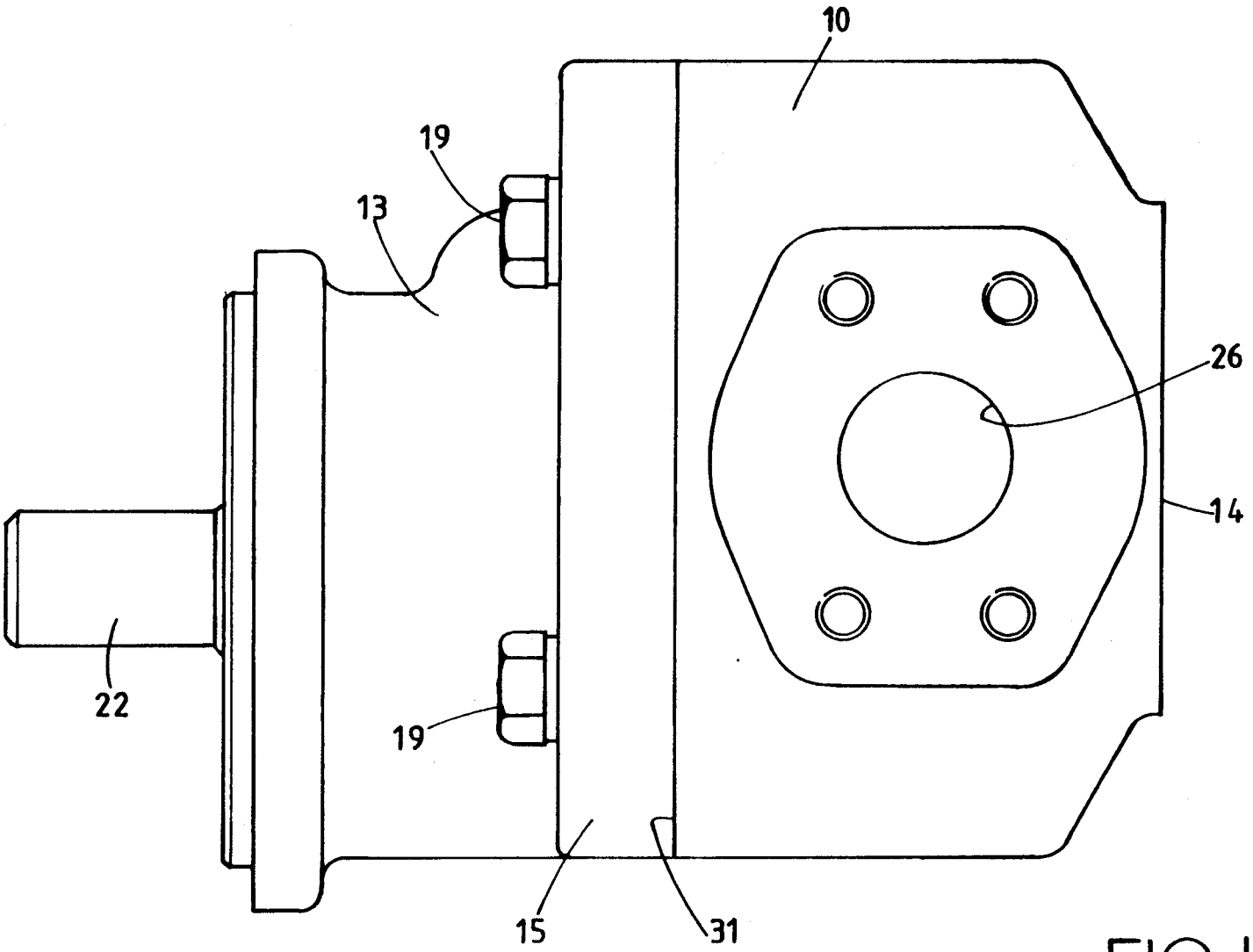
FIG. 1 is a side view of one embodiment of a rotary positive displacement hydraulic machine according to the present invention.
Figure 2:
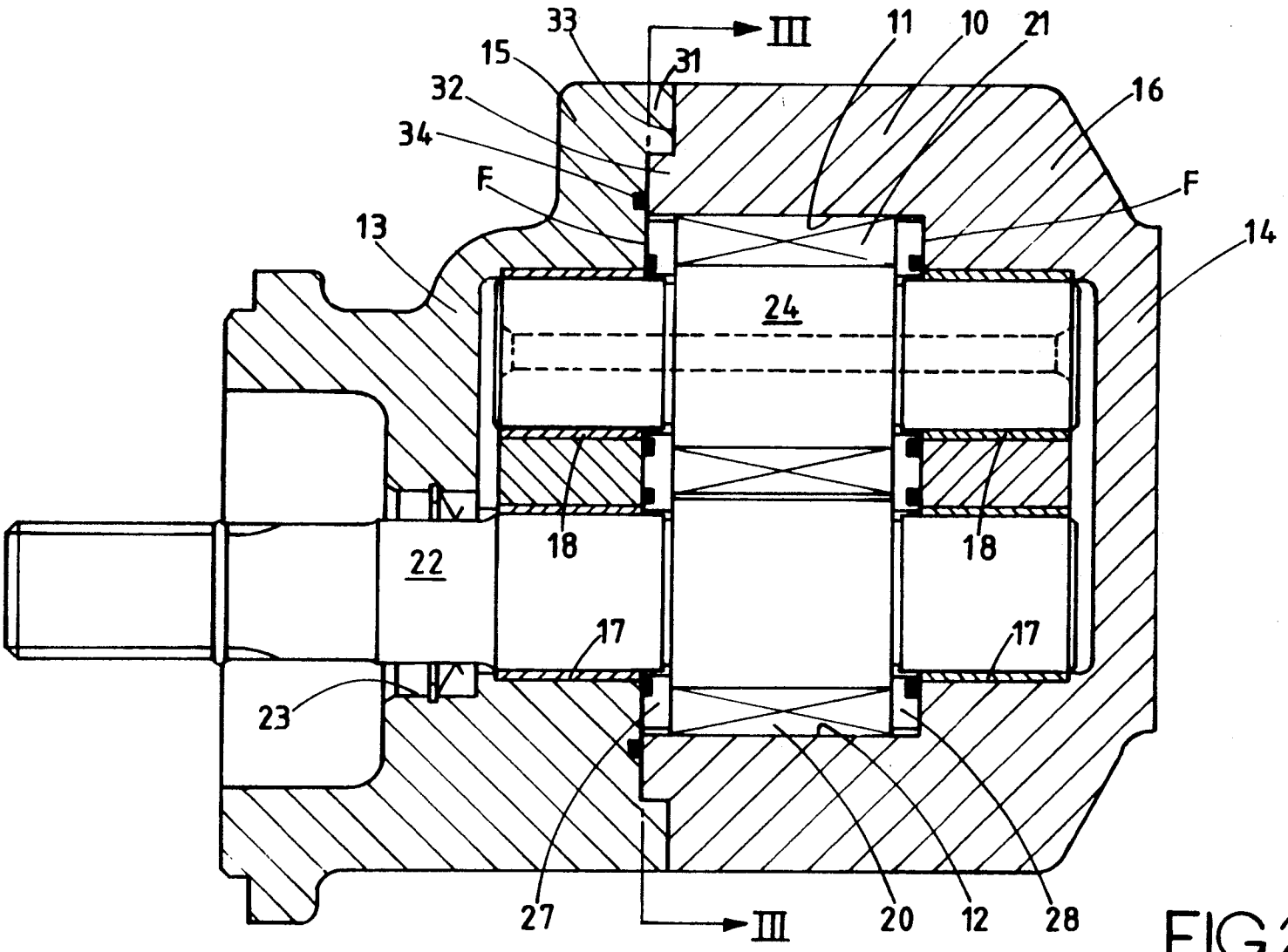
FIG. 2 is a longitudinal section through the machine of FIG. 1, taken along line II—II of FIG. 3.

Referring now to the drawings, the rotary positive displacement hydraulic machine shown therein is in the form of a gear pump. The pump has a pump body typically formed of cast iron and comprising a housing 10 which defines two mutually intersecting parallel working chambers 11 and 12, and two end covers 13 and 14 closing opposite ends of the parallel chambers 11 and 12.

Each end cover 13, 14 has an integral one piece bearing support 15, 16, respectively, each of which supports two sleeve bearings 17 and 18.

The pump as shown in the drawings has what is commonly referred to as a "pot-body" in which one end cover (end cover 14) is integral with the housing 10. The other end cover (end cover 13) together with its respective bearing support 15 is clamped to the housing by bolts 19.

Two meshing pump rotors in the form of steel gears 20 and 21 are mounted for rotation in chambers 11 and 12, respectively. The gear 20 is integral with a drive shaft 22 which is supported in the sleeve bearings 17 in the two bearing supports 15 and 16, and which passes through an aperture 23 in the end cover 13 so that it can be connected to a power source. The gear 21 is integral with a driven shaft 24 which is supported in the sleeve bearings 18 in the two bearing supports 15 and 16 and which is contained entirely within the pump body.

The pump body has a low pressure or inlet port 25 and a high pressure or outlet port 26, each of which communicates with both chambers 11 and 12.

The pump also includes two pressure balancing plates 27 and 28 interposed between the side faces of the two meshing gears 20 and 21 and respective bearing supports 15 and 16, with a small degree of axial freedom.

Figure 3:
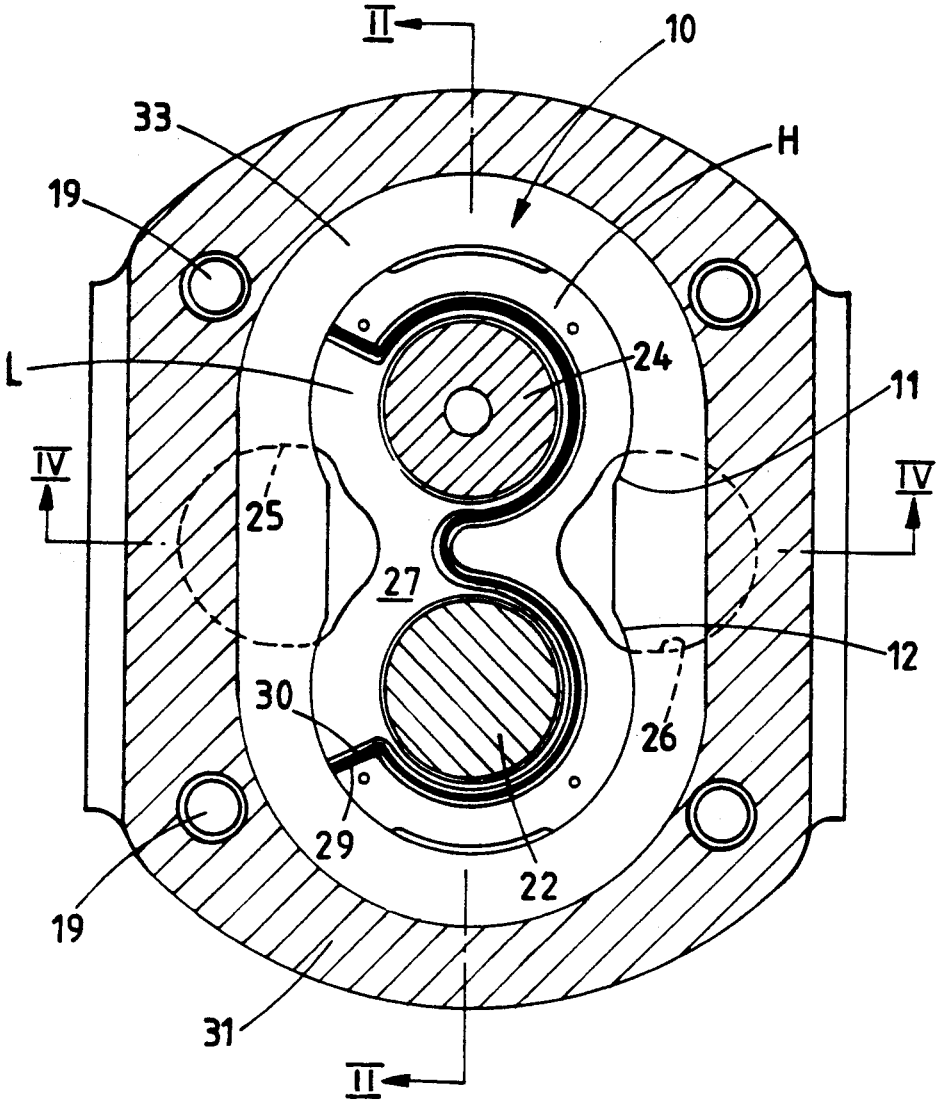
FIG. 3 is a sectional view taken along line III—III of FIG. 2.
Figure 4:
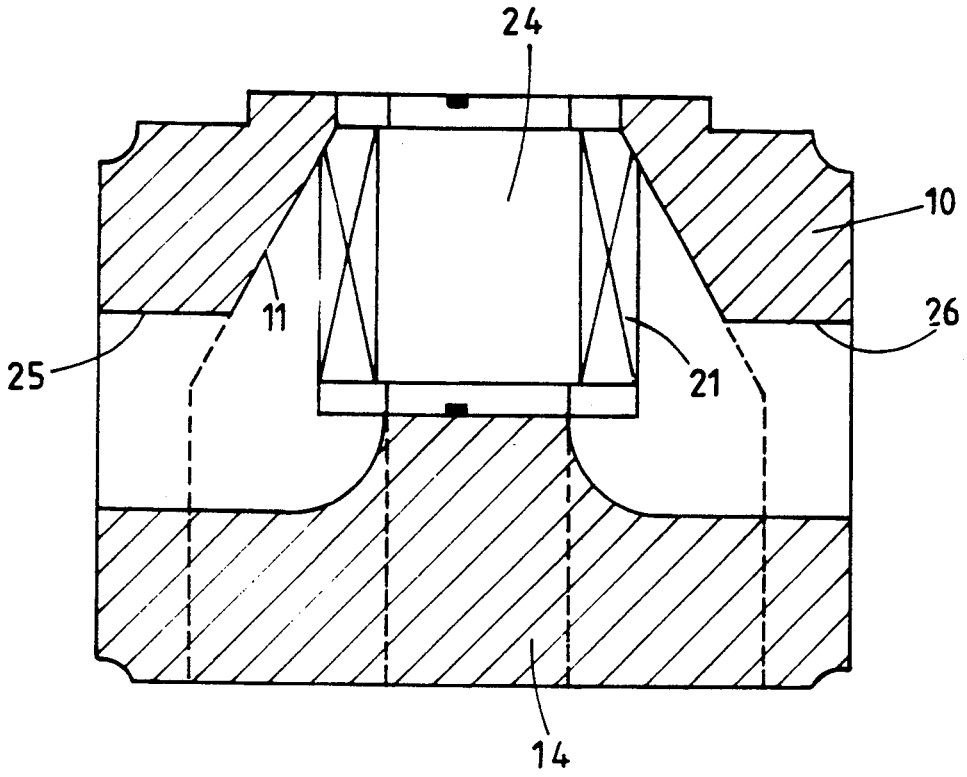
FIG. 4 is a sectional view taken along line IV—IV of FIG. 3.

The pressure balancing plates 27 and 28 are typically of leaded bronze, and the face F of each plate 27, 28 remote from the meshing gears is provided with contiguous rubber and plastic seals 29 and 30, respectively, mounted in a groove in the plate, although the seals 29 and 30 could be mounted in a groove in the end face of the adjacent bearing support. Each plate 27, 28 is of figure of eight shape and each seal 29, 30 is roughly in the shape of a figure three, but at each end has a tail which extends radially outwards to the outer edge of a respective plate 27, 28. Other seal configurations could be utilised including those which provide for bi-directional operation of the pump. As best shown in FIG. 3, the seals divide the face F of each plate into two areas, one of which is a high pressure area H and is in communication with the port 26 and the other of which is a low pressure area L and is in communication with the port 25.

The high and low pressure areas are designed to coincide with the high and low pressure sides of the pump so that when the pump is in operation liquid pressures acting upon the two areas L and H of the face F act in opposition to the pressure applied to the opposite face of each plate 27, 28 by the liquid being carried through the pump by the gears, and ensure that the plates 27, 28 are urged into adequate sealing engagement with the side faces of the gears without the generation of undue friction between the plates and the side faces.

As mentioned previously, the operating pressure on the delivery side of the pump is very high, often as high as 250 bar, and this pressure will act on the housing 10 on the delivery side of the pump in such a way that if unrestrained the housing will deflect outwards at its open end, i.e. that end connected to the end cover 13, and if this were to happen, it would result in increased radial clearance losses and a consequential reduction in volumetric efficiency of the pump. Also, the bearings of the pump will move out of alignment with the result that the performance and durability of the bearings will decrease.

In order to minimise this deflection, the open end of the housing 10 is received within a recess defined within the bearing support 15 so that the open end of the housing is supported by the bearing support 15 against outwards movement in a direction transverse to the axes of rotation of the meshing rotors. The recess is defined by a continuous flange 31 projecting from a peripheral region of the bearing support 15 in a direction parallel to the axes of rotation of the meshing rotors, and in order that the pump has a conventional external appearance, the open end of the housing 10 is in the form of a hollow spigot 32 surrounded by a continuous shoulder 33. The spigot 32 is a close fit within the flange 31 and the end of the spigot 32 is drawn into engagement with a continuous seal 34 located in a groove in the base of the recess in the bearing support 15, by the bolts 19. The spigot 32 and flange 31 are of matching non-circular shapes so preventing any angular displacement between the housing 10 and the bearing support 15.

The flange 31 supports the open end of the housing 10 against outwards deflection caused by high operating pressures on the delivery side of the pump and reduces movement of the bearing support 15 relative to the housing 10 caused by the bearing loads reacted between the bearing support 15 and the housing 10 with the result that radial clearance losses are minimised and bearing alignment is maintained so improving volumetric efficiency of the pump and durability of the bearings.

The embodiment described above is given by way of example only and various modifications will be apparent to persons skilled in the art without departing from the scope of the invention. For example, the pump could be operated as a motor. The spigot 32 need not necessarily be an integral part of the housing: it could instead be a separate part fitted in a groove in the end of the housing. The bearing support 16 together with the end cover 14 could be separate from the housing 10, but in this case opposite ends of the housing 10 are received within recesses defined within respective bearing supports. The bearing supports could be separate from the end covers and, in this case, the housing, bearing supports and end covers can be clamped together by bolts extending therethrough. It may be possible to omit one of the pressure balancing plates. Also, any number of meshing rotors may be provided.

What I claim is:

1. A rotary positive displacement hydraulic machine in the form of a gear pump or motor comprising a housing having two ends and a periphery and defining two mutually intersecting parallel working chambers having opposite ends, two meshing rotors mounted for rotation in the two chambers, respectively, and two bearing supports at said opposite ends of the chambers and each supporting bearings in which the two rotors are journalled for rotation, wherein the housing has at least one open end and wherein said at least one open end of the housing has a non-circular inner rim which is received within a recess of matching non-circular shape defined by a continuous flange projecting from a peripheral region of a respective bearing support in a direction parallel to the axes of rotation of the meshing rotors, the inner rim being contiguous with the chambers and being surrounded by a shoulder extending from the inner rim to the periphery of the housing, so that said at least one open end of the housing is supported by its bearing support against outward deflection under the effect of fluid pressure in the chambers in a plane transverse to the axes of rotation of the meshing rotors.

2. A rotary positive displacement hydraulic machine as claimed in claim 1, wherein one end of the housing is closed by an integral end cover.

3. A rotary positive displacement hydraulic machine as claimed in claim 2, wherein the bearing support at the said one end of the housing is integral with the said integral end cover.

4. A rotary positive displacement hydraulic machine as claimed in claim 1, wherein said at least one open end of the housing is closed by a removable end cover.

5. A rotary positive displacement hydraulic machine as claimed, in claim 4, wherein the bearing support at said at least one open end of the housing is integral with its respective end cover.

6. A rotary positive displacement hydraulic machine as claimed in claim 1, wherein a pressure balancing plate is interposed between the meshing rotors and an adjacent bearing support and an area of that face of the pressure balancing plate which is remote from the meshing rotors communicates with the working space of the machine so that, in use, the pressure balancing plate is urged into adequate sealing engagement with the meshing rotors without the generation of undue friction between the pressure balancing plate and the rotors.

* * * * *